US012742609B2

(12) United States Patent
Huang et al.

(10) Patent No.: US 12,742,609 B2
(45) Date of Patent: Sep. 22, 2026

(54) TOY RIFLE

(71) Applicant: Guangzhou Huoshi Chuanyu Technology Co., Ltd., Guangzhou (CN)

(72) Inventors: Jiu Huang, Lianjiang (CN); Chunyang Wang, Zhumadian (CN); Zhaofeng Yan, Yiyang (CN); Haiyu Dai, Wuchuan (CN); Baoqi Wang, Tongchuan (CN); Xiaoqin Shi, Ji'ning (CN)

(73) Assignee: Guangzhou Huoshi Chuanyu Technology Co., Ltd., Guangzhou (CN)

( * ) Notice: Subject to any disclaimer, the term of this patent is extended or adjusted under 35 U.S.C. 154(b) by 228 days.

(21) Appl. No.: 18/666,926

(22) Filed: May 17, 2024

(65) Prior Publication Data

US 2025/0085076 A1 Mar. 13, 2025

(51) Int. Cl.
*F41A 33/06* (2006.01)

(52) U.S. Cl.
CPC ..... *F41A 33/06* (2013.01)

(58) Field of Classification Search
CPC ..... F41A 33/06; F41B 11/89
See application file for complete search history.

(56) References Cited

U.S. PATENT DOCUMENTS

| | | | | |
|---|---|---|---|---|
| 9,243,865 | B1 * | 1/2016 | Bruhns | F41C 23/10 |
| 2003/0056778 | A1 * | 3/2003 | Schavone | F41B 11/721 124/74 |
| 2007/0275354 | A1 * | 11/2007 | Beckmann | F41A 33/06 89/1.816 |
| 2013/0247893 | A1 * | 9/2013 | Yang | F41B 11/721 124/56 |
| 2016/0084605 | A1 * | 3/2016 | Monti | A63F 13/245 463/2 |
| 2021/0310758 | A1 * | 10/2021 | Kellgren | F41A 9/12 |
| 2022/0018625 | A1 * | 1/2022 | Dvorak | F41A 33/06 |
| 2022/0236031 | A1 * | 7/2022 | Sandgren | F41B 11/56 |

* cited by examiner

*Primary Examiner* — Peter R Egloff
(74) *Attorney, Agent, or Firm* — Olive Law Group, PLLC

(57) ABSTRACT

A toy rifle, including a first grip, a second grip, a front frame, a rear frame, a sliding component, a trigger and a restrainer; the first grip and second grip are respectively provided with a grip protector; the front frame is mounted on the first grip and second grip; the sliding component further includes a cylinder, a gas nozzle, a gas transmission unit, and a restrainer; when a player pulls the trigger, an external gas pump communicates with the cylinder through a pipe; an air pressure drives the sliding component to move and produce a reverse force, thereby forming a recoil force; the recoil force works back on the player, thereby increasing a simulation effect and experience.

7 Claims, 4 Drawing Sheets

TOY RIFLE

TECHNICAL FIELD

The present invention relates to the field of toy gun, in particular to a toy rifle.

BACKGROUND

Toy gun is a kind of children's toys based on model guns, which is a kind of model toys. Toy guns are divided into water guns, scaled model guns, toy guns that combine sound and light and other types. The scaled model guns are the closest to real guns, which are loved by many children.

Existing scaled model guns can simulate the weight and action of the real guns when being played, and the safety can be ensured without the actual launch. However, in the process of pulling the trigger, the model guns cannot simulate the recoil generated by the gun shooting, and the player cannot feel the shooting recoil, which reducing the authenticity of playing with the model guns, which leads to the poor feelings in process of simulative shooting, affecting the using effect of the toy guns and existing limitations of the poor simulation effect and experience.

SUMMARY

The main purpose of the present invention is to provide a toy rifle, which can effectively solve the problems described above.

In order to realize the above purpose, the technical solution adopted in the present invention are as follows:

A toy rifle comprises a first grip and a second grip; the first grip and the second grip are respectively provided with a grip protector; a front frame is arranged on the first grip and the second grip; the front frame connects to a rear frame; the toy rifle further comprises a sliding component; the front frame and the rear frame are arranged on the sliding component; the sliding component further comprises an inner tube, a silencer, a sliding block and a cylinder; the toy rifle further comprises a gas nozzle restrainer, which is arranged on an upper end inside the first grip and the second grip, adjacent to the front frame; the toy rifle further comprises a gas nozzle, which connects to the gas nozzle restrainer; the toy rifle further comprises a gas transmission unit, which connects to a lower end of the gas nozzle restrainer; the toy rifle further comprises a trigger, which connects to the first grip and the second grip; the toy rifle further comprises a micro switch and a restrainer; the micro switch is arranged inside the first grip and the second grip; the restrainer is arranged on a lower end of the first grip and the second grip.

Preferably, a frame connector is arranged on a joint position between the front frame and the rear frame; the frame connector connects the front frame and with the rear frame.

Preferably, the silencer is arranged on an end of the inner tube; an other end of the inner tube far away from the silencer is disposed inside the front frame and the rear frame; a sliding block and a cylinder are arranged on the other end of the inner tube away from the silencer; the cylinder connects to the gas nozzle.

Preferably, the end of the inner tube is provided with a baffle and a correction rubber ring; the inner tube is further provided with a second reset spring; two ends of the second reset spring are respectively connect to the frame connector and the sliding block; a sight component is mounted on the front frame; a front grip and a button component are arranged on the rear frame.

Preferably, an O-shaped sealing ring is arranged on a connection position between the gas nozzle—and the cylinder; the trigger is in contact with the micro switch; a first reset spring is arranged within the first grip and second grip; the first reset spring connects with the trigger.

Preferably, one end of the second reset spring connects to the frame connector; an other end of the second reset spring connects to the sliding block.

Preferably, the inner tube is slidably arranged on the frame connector.

Compared with the prior art, the beneficial effects of the present invention are: the toy rifle, with a sliding component structures of a cylinder, a gas nozzle, a microswitch, a gas transmission unit, and a restrainer, brings a player with a vivid shooting experience when using the toy rifle; the restrainer connects to an external gas pump pipeline, when the player pulls the trigger, airs in an external gas pump go into the pipeline and then enters into the cylinder via the gas nozzle; at this moment, an air pressure drives the sliding component to move and produce a reverse force, forming a recoil force; the recoil force works back to the player, which increases the simulation effect and experience. The second reset spring plays a role in restoring the position of the sliding component, which ensures a repeatedly simulative shooting experience for the player.

REFERENCE SIGNS IN THE DRAWINGS

1. first grip; 2. second grip; 3. grip protector; 4. front frame; 5. rear frame; 6. frame connector; 7. inner tube; 8. silencer; 9. baffle; 10. correction rubber ring; 11. sight component; 12. front grip; 13. rear support connecting tube; 14. rear support; 15. sliding block; 16. cylinder; 17. gas nozzle; 18. O-shaped sealing ring; 19. gas nozzle restrainer; 20. gas transmission unit; 21. trigger; 22. microswitch; 23. first reset spring; 24. restrainer; 25. button component; 26. second reset spring.

DESCRIPTION OF EMBODIMENTS

In order to make it easy to understand the technical means, creative features, purposes and effects of the present invention, the present invention will be further elaborated below combined with the specific embodiments.

Figure 1:
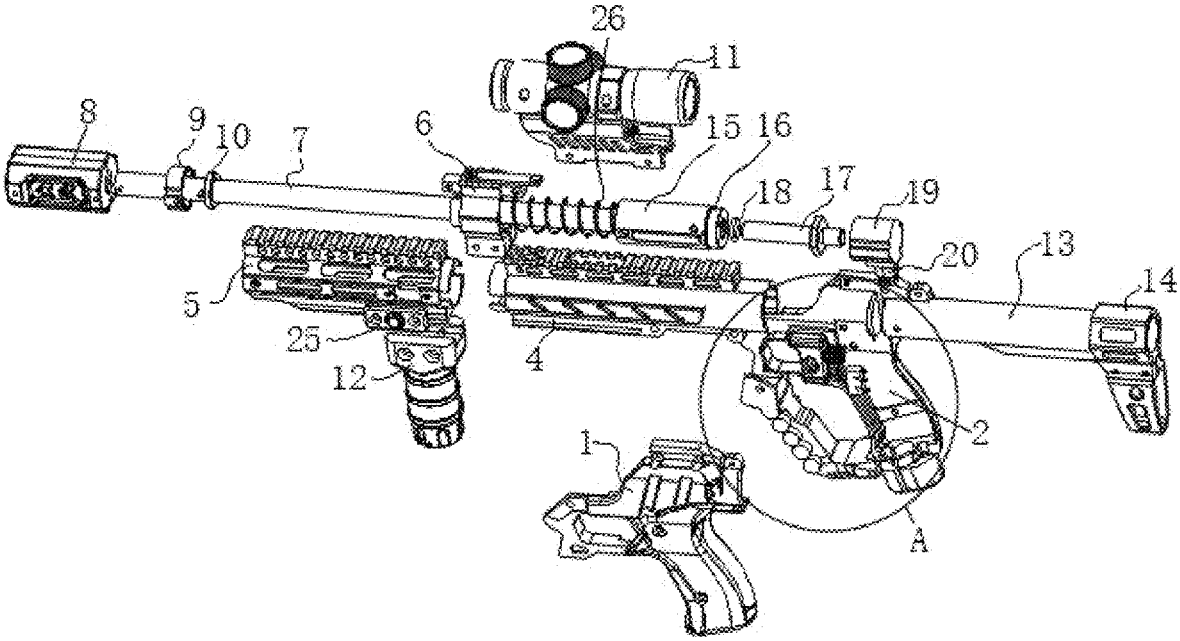
FIG. 1 is a entire structural diagram of the present invention.
Figure 2:
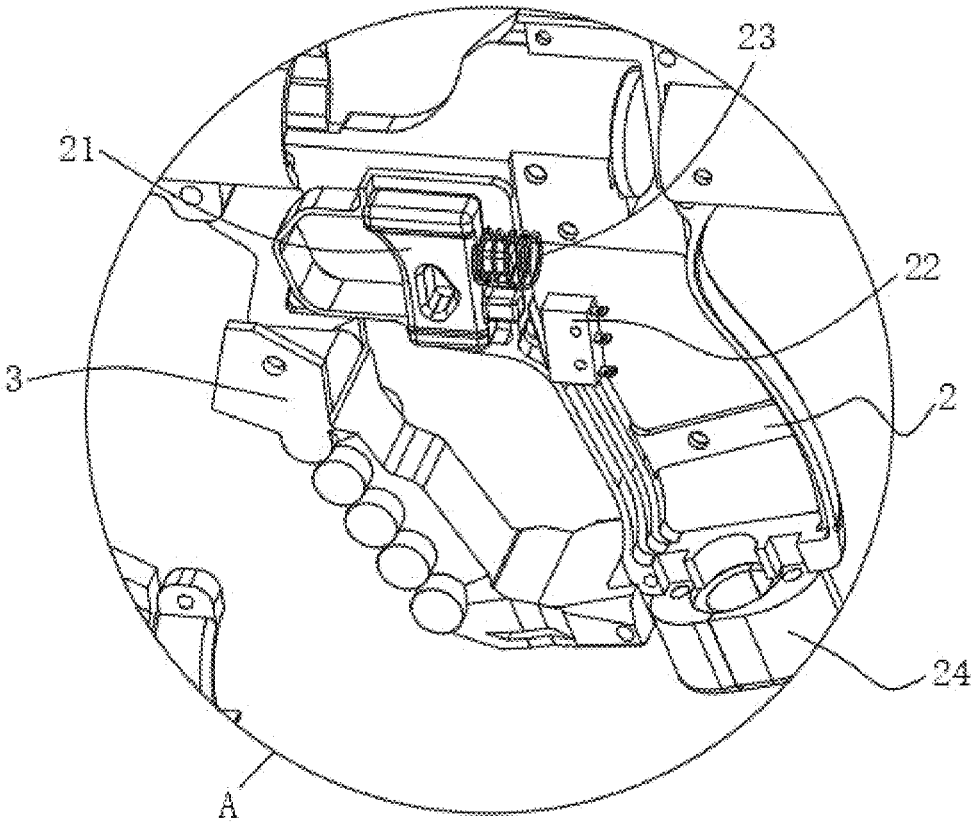
FIG. 2 is an enlarged view of the portion A in FIG. 1.
Figure 3:
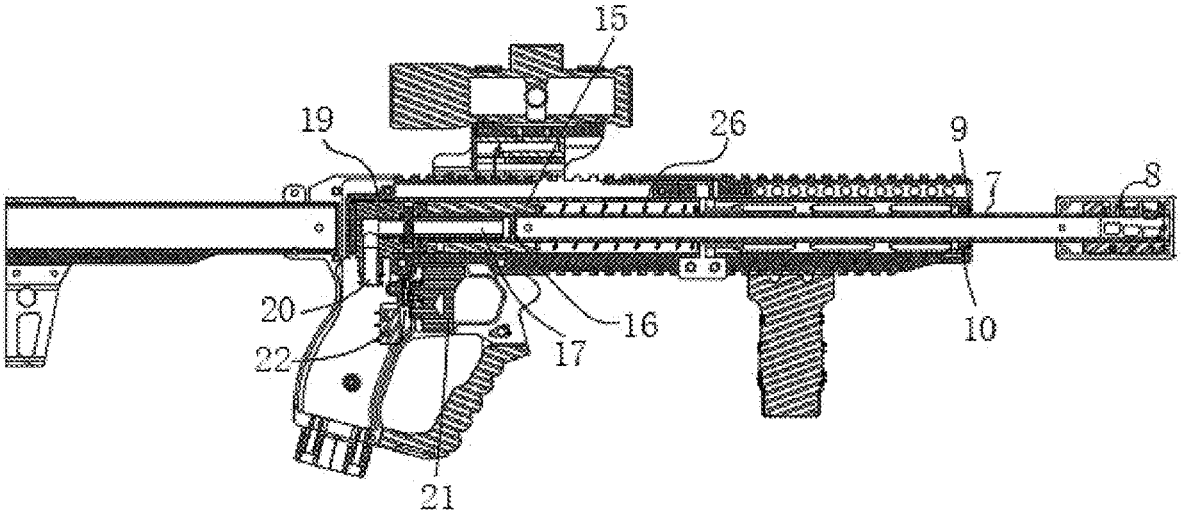
FIG. 3 is a section view of the present invention.
Figure 4:
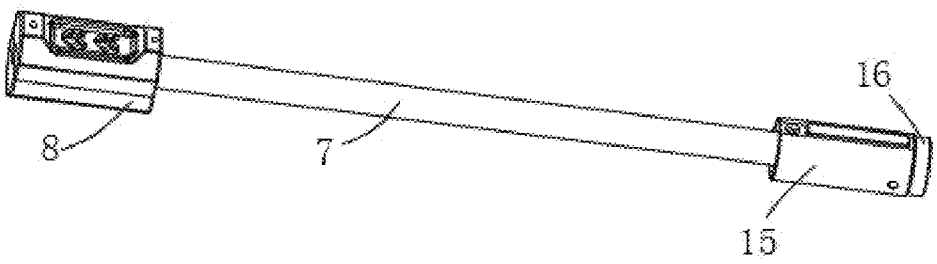
FIG. 4 is a structural diagram of the sliding component of the present invention.

As shown in FIGS. 1-FIG. 4, a toy rifle includes first grip 1 and second grip 2, the first grip 1 and the second grip 2 are respectively provided with a grip protector 3, and a front frame 4 connects the first grip 1 and the second grip 2; the front frame 4 connects with rear frame 5, the sliding component is arranged within the front frame 4 and the rear frame 5; the sliding component further comprises an inner tube 7, a silencer 8, a sliding block 15 and a cylinder 16; a gas nozzle restrainer 19 is arranged on an upper end between the first grip 1 and the second grip 2, adjacent to the front frame 4; the gas nozzle restrainer 19 connects to the gas nozzle 17; a gas transmission unit 20 is arranged on a lower end of the gas nozzle restrainer 19; a trigger 21 is arranged between the first grip 1 and the second grip 2; a micro switch 22 is arranged inside the first grip 1 and the second grip 2. A restrainer 24 is arranged at a lower end of the first grip 1 and the second grip 2; a frame connector 6 is arranged on a joint position between the front frame 4 and the rear frame 5; the frame connector 6 connects the front frame 4 and the rear frame 5; a baffle 9 and a correction rubber ring 10 are arranged at the end of the inner tube 7 close to the silencer 8. The inner tube 7 is provided with a second reset spring 26; two ends of the second reset spring 26 respectively connect to the frame connector 6 and the sliding block 15. The front frame 4 is provided with a sight component 11; the rear frame 5 is provided with a front grip 12 and button component 25; a rear support connecting tube 13 connects the first grip 1 and the second grip 2; an end of the rear support connecting tube 13 connects to the an rear support 14; an end of the second reset spring 26 connects to the frame connector 6; an other end of the second reset spring 26 connects to the sliding block 15. The inner tube 7 is slidably arranged on the frame connector 6.

Through the above embodiments, the silencer 8 is arranged on an end of the inner tube 7; an other end of the inner tube 7 far away from the silencer 8 is arranged within the front frame 4 and the rear frame 5. The sliding block 15 and the cylinder 16 are installed on the other end of the inner tube 7 far away from the silencer 8. The cylinder 16 connects to the gas nozzle 17; an O-shaped sealing ring 18 is arranged on a connection position between the cylinder 16 and the gas nozzle 17. The trigger 21 is in contact with the micro switch 22; a first reset spring 23 is arranged inside the first grip 1 and the second grip 2; the first reset spring 23 connects with the trigger 21; thanks to the sliding component structures, including the cylinder 16, the gas nozzle 17, the micro switch 22, the gas transmission unit 20, and the restrainer 24, etc., when a player plays with the toy rifle and pulls the trigger 21, since the restrainer 24 connects to an external gas pump pipeline, airs in an external gas pump go into the pipeline and then enters into the cylinder 16 via the gas nozzle 17, an air pressure the sliding component to move and produce a reverse force, forming a recoil force; the recoil force works back to the players, which increases a game simulation effect and experience; the second reset spring plays a role in restoring the sliding component, which ensures a repeated simulative shooting experience for the player.

When using the toy rifle, the player needs to have the first grip 1 and the second grip 2 assembled as a rear grip. The rear grip connects the front frame 4 and the grip protector 3; at the same time, the rear support 14 is installed on the rear grip through the rear support connecting tube 13. The rear frame 5 is mounted to the front frame 4 through the frame connector 6, and the sliding component is arranged inside the front frame 4 and the rear frame 5. Through connecting the restrainer 24 and the pipeline of the external gas pump, the player holds the-toy rifle via the rear grip and the front grip 12, while the rear support 14 rests against shoulder of the player. When the player pulls the trigger 21, the toy rifle brings the player with a simulative shooting; it should be noted that the trigger 21 connects to the micro switch 22; thus, the first reset spring 23 is compressed at the same time. When the player releases the trigger 21, the first reset spring 23 drives the trigger 21 to reset; once the player pulls the trigger 21 again to press the micro switch 22, the air in the external gas pump enters into the gas nozzle 17 at the gas nozzle restrainer 19 through the gas transmission unit 20; the air then goes into the cylinder 16 through the gas nozzle 17 to form an air pressure, which drives the sliding component to move; during this process, the inner tube 7 moves inside the front frame 4 and the rear frame 5 through the slide block 15; the silencer 8 makes sound disappear. During the movement of the sliding block 15 towards the frame connector 6, the second reset spring 26 is compressed under an extended elastic potential energy; the sliding component is moved out of the gas nozzle 17 as the sliding component moves forward; the the air in the cylinder 16 completely goes out, the sliding component resets to an initial state under an action of the second reset spring 26; at this time, a simulative shooting action is completed. In the process of moving the sliding component, a reverse force is generated, and the reverse force works back to the shoulder of the player via the rear support connecting tube 13 and the rear support 14, thereby realizing the effect fed back by the recoil and improving the shooting experience sense. When a one shooting action is completed, the players continues to pull the trigger 21 to repeat the simulative shooting; in the whole process of the sliding component movement, the baffle 9 plays a blocking role; the correction rubber ring 10 ensures the relative accuracy of the sliding component, which ensures the using effect of the toy rifle.

The above content describes the principle of use, features and beneficial effects of the present invention. The relevant person in the field can understand according to the above content. The above content does not limit the present invention, and the above embodiments and specification describe the basic principles and characteristics of the present invention. On the premise of conforming to the concept of the present invention, the present invention can also undergo various changes and improvements, and these improvements should all be involved in the scope of protection claimed by the present invention.

What is claimed is:

1. A toy rifle, which comprises a first grip, a second grip, a front frame, and a rear frame, the first grip and the second grip are respectively connected with a grip protector, and the first grip and the second grip are fixedly connected to the front frame, which is connected with the rear frame, wherein the toy rifle further comprises a sliding component, which comprises an inner tube, a silencer, a sliding block and a cylinder; the front frame and the rear frame are connected with the sliding component;

wherein the toy rifle further comprises a gas nozzle restrainer, which is installed on an upper end inside the first grip and the second grip, adjacent to the front frame;

wherein the toy rifle further comprises a gas nozzle, which connects to the gas nozzle restrainer;

wherein the toy rifle further comprises a gas transmission unit, which connects to a lower end of the gas nozzle restrainer;

wherein the toy rifle further comprises a trigger, which connects to the first grip and the second grip;

wherein the toy rifle further comprises a microswitch, which is arranged inside the first grip and second grip;

wherein the toy rifle further comprises a restrainer, which is arranged on a lower end of the first grip and the second grip;

wherein the toy rifle further comprises a sight component, which is mounted on the front frame; and wherein the toy rifle further comprises a front grip and a button component; the front grip and the button component are arranged on the rear frame.

2. The toy rifle according to claim 1, wherein a frame connector is arranged on a joint position between the front frame and the rear frame; the frame connector fixedly connects the front frame with the rear frame.

3. The toy rifle according to claim 2, wherein the silencer is fixedly arranged on an end of the inner tube; an other end of the inner tube far away from the silencer is disposed inside the front frame and the rear frame; the sliding block and the cylinder are mounted on the other end of the inner tube far away from the silencer; the cylinder communicates with the gas nozzle.

4. The toy rifle according to claim 3, wherein the end of the inner tube is provided with a baffle and a correction rubber rings; the inner tube is further provided with a second reset spring; two ends of the second reset spring respectively connect to the frame connector and the sliding block.

5. The toy rifle according to claim 4, wherein an O-shaped sealing ring is arranged on a connection position between the gas nozzle and the cylinder; the trigger contacts the microswitch; a first reset spring is arranged within the first grip and the second grip; the first reset spring connects with the trigger.

6. The toy rifle according to claim 4, wherein an end of the second reset spring connects to the frame connector; an other end of the second reset spring connects to the sliding block.

7. The toy rifle according to claim 5, wherein the inner tube is slidably arranged on the frame connector.

* * * * *